US008642912B2

(12) United States Patent
Lee

(10) Patent No.: US 8,642,912 B2
(45) Date of Patent: Feb. 4, 2014

(54) VACUUM CIRCUIT BREAKER

(75) Inventor: Dong Sik Lee, Chungcheongbuk-Do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 433 days.

(21) Appl. No.: 12/982,782

(22) Filed: Dec. 30, 2010

(65) Prior Publication Data

US 2011/0155697 A1 Jun. 30, 2011

(30) Foreign Application Priority Data

Dec. 31, 2009 (KR) ..... 10-2009-0136236

(51) Int. Cl.
*H01H 33/28* (2006.01)

(52) U.S. Cl.
USPC ..... 218/120; 218/140; 218/153

(58) Field of Classification Search
USPC ..... 218/7, 14, 120, 140, 152–154
See application file for complete search history.

(56) References Cited

U.S. PATENT DOCUMENTS

| | | | | |
|---|---|---|---|---|
| 4,150,270 | A * | 4/1979 | Zunick | 218/138 |
| 6,198,062 | B1 * | 3/2001 | Mather et al. | 218/152 |
| 6,759,617 | B2 * | 7/2004 | Yoon | 218/153 |
| 7,829,814 | B2 * | 11/2010 | Marchand et al. | 218/140 |
| 2002/0067230 | A1 | 6/2002 | Yoon | |

FOREIGN PATENT DOCUMENTS

| | | |
|---|---|---|
| CN | 1357902 | 7/2002 |
| CN | 201007972 | 1/2008 |
| EP | 1343233 | 9/2003 |
| EP | 2139016 | 12/2009 |
| JP | 50-112964 | 9/1975 |
| JP | 56-167444 | 12/1981 |
| JP | 5-509197 | 12/1993 |
| JP | 6-103863 | 4/1994 |
| JP | 9-63423 | 3/1997 |
| JP | 2002-216597 | 8/2002 |
| JP | 2004-236398 | 8/2004 |
| WO | 2004010448 | 1/2004 |

OTHER PUBLICATIONS

Japan Patent Office Application Serial No. 2010-293449, Notice of Allowance dated Sep. 25, 2012, 2 pages.
The State Intellectual Property Office of the People's Republic of China Application Serial. No. 201010622367.9, Office Action dated Feb. 27, 2013, 6 pages.

* cited by examiner

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

Disclosed is a vacuum circuit breaker. As a plurality of components of main circuit units are integrally formed as one module by molding using epoxy, the main circuit units are easily fabricated, and assembly errors are prevented. Since the main circuit units are arranged to be symmetrical to each other based on a driving unit, an insulation distance between a switchgear and the main circuit units can be obtained without increasing a size of the switchgear. This may allow the main circuit units to be easily arranged at the right side or at the left side according to an installation state of the switchgear.

7 Claims, 5 Drawing Sheets

VACUUM CIRCUIT BREAKER

CROSS-REFERENCE TO A RELATED APPLICATION

Pursuant to 35 U.S.C. §119(a), this application claims the benefit of earlier filing date and right of priority to Korean Application 10-2009-0136236, filed on Dec. 31, 2009, the content of which is incorporated by reference herein in its entirety.

BACKGROUND OF THE INVENTION

1. Field of the Invention

The present invention relates to a vacuum circuit breaker, and particularly, to a vacuum circuit breaker capable of molding a vacuum interrupter by epoxy, and symmetrically arranging main circuit units at a center portion of a driving unit.

2. Background of the Invention

A switchgear serves to monitor or control or protect an electricity system used to transmit or to distribute power received from a power plant or a substation to a house. This switchgear consists of a structure for supporting or protecting unitary devices (circuit breaker, protection relay, etc.) attached thereto, and wires for connecting the unitary devices to each other. And, the switchgear is categorized into a gas insulation switchgear and an air insulation switchgear according to an insulation method therein. In the aspects of functions, the switchgear may be classified into a switchgear for monitoring an electricity system, a switchgear for opening and closing an electricity system, a switchgear for converting power by a semiconductor device, etc., and so on.

A circuit breaker is an electricity protecting apparatus capable of protecting a load device and a line from an accidental current due to a shortening, a ground accident, etc. that may occur on an electric circuit. According to an extinguishing medium, the circuit breaker is classified into an oil circuit breaker using oil as an extinguishing medium, a gas circuit breaker using sulfur hexafluoride ($SF_6$), inactive gas, an air circuit breaker using air as an extinguishing medium, a vacuum circuit breaker using a vacuum state, etc. Hereinafter, the vacuum circuit breaker of the switchgear for opening and closing an electricity system will be explained.

FIG. 1 is a perspective view of a vacuum circuit breaker in accordance with the conventional art, and FIG. 2 is a perspective view of main circuit units of the vacuum circuit breaker of FIG. 1, which is shown from a different angle from FIG. 1.

As shown, the conventional vacuum circuit breaker comprises a driving unit 10 configured to generate a driving force, main circuit units 20 configured to break a circuit by using a driving force generated from the driving unit 10, and a frame unit 30 installed between the driving unit 10 and the main circuit units 20, and configured to transmit a driving force generated from the driving unit 10 to the main circuit units 20.

A rotation shaft 11 for transmitting a driving force is installed at the driving unit 10. And, a connection member 12 and a conversion link 13 for converting a rotary motion of the rotation shaft 11 to a horizontal motion of a transfer link 31 to be later explained are coupled to the rotation shaft 11. The connection member 12 is integrally coupled to the rotation shaft 11, and the conversion link 13 is rotatably coupled to the connection member 12.

The main circuit units 20 include an epoxy housing 21, a vacuum interrupter 22 mounted in the epoxy housing 21, an upper conductor 23 and a lower conductor 24 coupled to conductors disposed at both sides of the vacuum interrupter 22, and an insulation rod 25 coupled to the frame unit 30 and operating the vacuum interrupter 22 by a driving force transferred through the frame unit 30.

The epoxy housing 21 is formed in a hollow cylindrical shape, and the vacuum interrupter 22 is vertically installed at an inner space of the housing 21 with an interval from an inner circumferential surface of the epoxy housing 21. The upper conductor 23 and the lower conductor 24 are inserted into the epoxy housing 21 in a horizontal direction, thereby being mechanically coupled to conductors (not shown) of the vacuum interrupter 22. Under these configurations, the vacuum interrupter 22 is supported at the epoxy housing 21 by the upper conductor 23 and the lower conductor 24.

The frame unit 30 includes a transfer link 31, a supporting plate 32, a spring guide 33, a direction conversion link 34, a contact pressure spring 35, etc., and is configured to convert a rotary motion of the rotation shaft 11 into a horizontal motion.

The conventional vacuum circuit breaker rotates the rotation shaft 11 by using a driving force generated from the driving unit 10.

A rotary force of the rotation shaft 11 is converted into a linear force via the connection member 12 and the conversion link 13, and then is transferred to the transfer link 31 of the frame unit 30. The transfer link 31 is moved to a horizontal direction by the conversion link 13.

The horizontal motion in back and forth directions is converted into a vertical motion, through the contact pressure spring 35 and the direction conversion link 34 connected to the transfer link 31. As the insulation rod 25 and a movable contact inside the main circuit units 20 vertically move, the movable contact comes in contact with a fixed contact. Even after the movable contact has come in contact with the fixed contact, the rotation shaft 11 rotated by a driving force generated from the driving unit 10 continues to receive a rotary force. As a result, the transfer link 31 receives a force to continue a horizontal motion. However, the direction conversion link 34 is not moved any longer. Accordingly, the spring supporting plate 32 is horizontally moved along the spring guide 33 thereby to compress the contact pressure spring 35. In a state that the contacts have a constant contact pressure therebetween, a closing operation is completed. This may allow the contact pressure to overcome an electronic repulsive force during a current flowing operation, and to be utilized as energy during a current breaking operation.

On the contrary, when separating the movable contact from the fixed contact by removing a latch for maintaining a closed state from the driving unit 10, an opening operation is performed in a direction opposite to that of the closing operation.

The conventional vacuum circuit breaker may have the following problems.

Firstly, one main circuit unit 20 is implemented by assembling the epoxy housing 21, the vacuum interrupter 22, the upper conductor 23 and the lower conductor 24 to one another. This may increase fabrication time and may cause assembly errors.

Secondly, the frame unit 30 is eccentrically installed to the right side or the left side with respect to the driving unit 10. Accordingly, when the upper conductor 23 and the lower conductor 24 installed on side surfaces of the main circuit unit 20 are rotated by 180°, the upper conductor 23 and the lower conductor 24 cannot obtain a sufficient insulation distance from a panel of the switchgear. This may increase a width of the panel of the switchgear to increase a size of the switchgear.

SUMMARY OF THE INVENTION

Therefore, an object of the present invention is to provide a vacuum circuit breaker capable of enhancing an insulation characteristic, simplifying assembly processes and reducing assembly errors by integrally forming main circuit units as one module.

Another object of the present invention is to provide a vacuum circuit breaker capable of obtaining a sufficient insulation distance between main circuit units and a panel of a switchgear without increasing a width of the switchgear when arranging the main circuit units at a right side or a left side.

To achieve these and other advantages and in accordance with the purpose of the present invention, as embodied and broadly described herein, there is provided a vacuum circuit breaker, comprising: a driving unit configured to generate a driving force necessary to perform a breaking operation; a frame unit horizontally coupled to the driving unit, and configured to transfer a driving force of the driving unit; and main circuit units vertically coupled to the frame unit, and having vacuum interrupters for performing a breaking operation by receiving a driving force from the frame unit, wherein the main circuit unit comprises a housing configured to accommodate the vacuum interrupter therein; a first conductor mechanically coupled to the vacuum interrupter so as to be electrically connected thereto, and electrically connected to one busbar of a switchgear; and an insulation rod having both ends coupled to the vacuum interrupter and the frame unit, and configured to operate the vacuum interrupter by a driving force transferred through the frame unit, wherein the housing is provided with a sealing portion integrally coupled to the vacuum interrupter by molding, and a space portion having an opened lower end so as to moveably accommodate the insulation rod therein is formed at a lower end of the sealing portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a vacuum circuit breaker according to the present invention will be explained in more detail with reference to the attached drawings.

Figure 1:
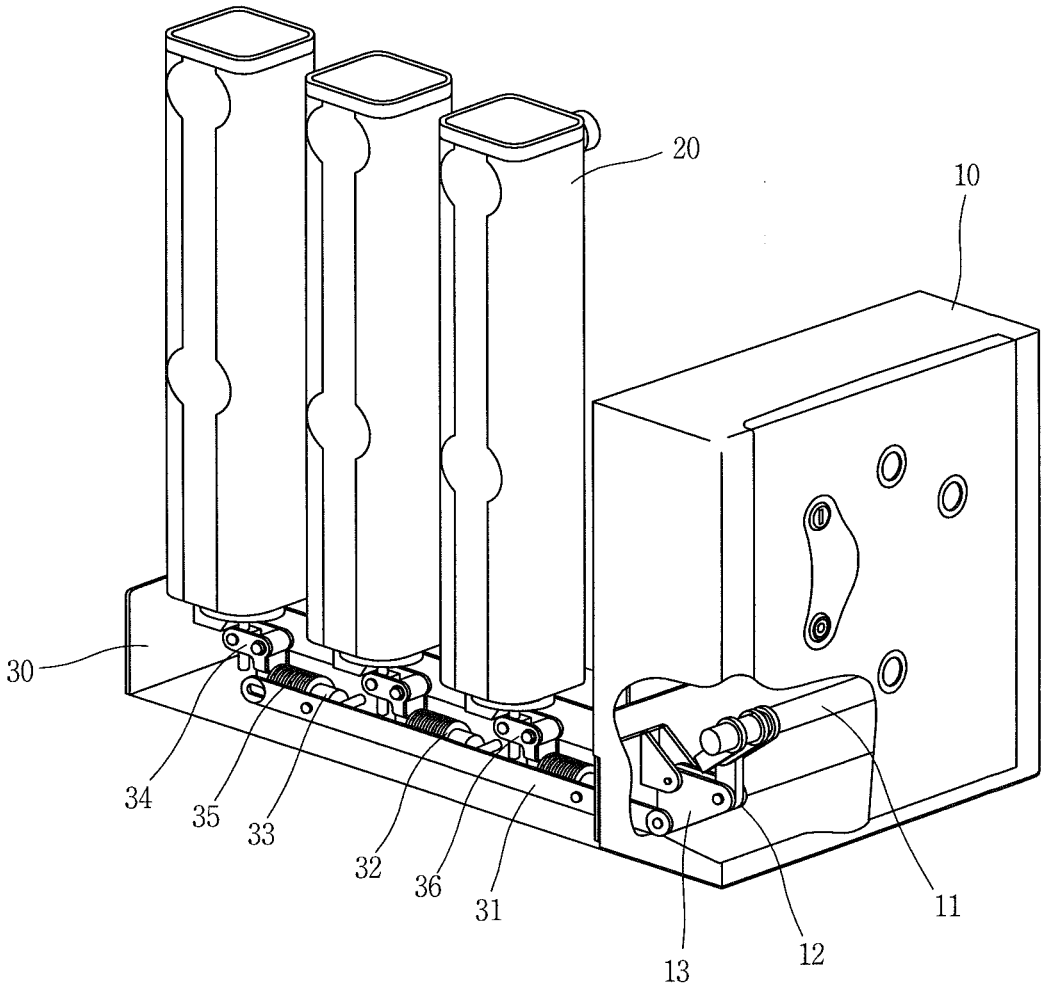
FIG. 1 PRIOR ART
FIG. 1 is a perspective view of a vacuum circuit breaker in accordance with the conventional art.
Figure 2:
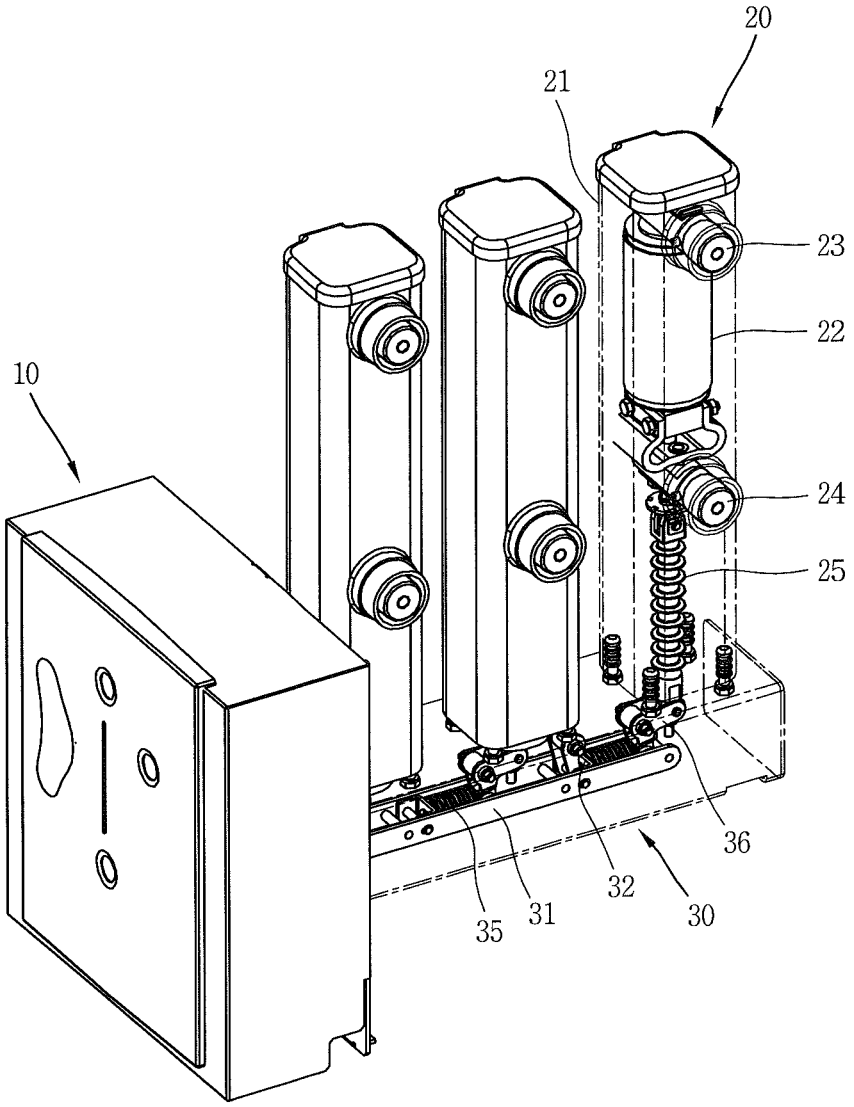
FIG. 2 PRIOR ART
FIG. 2 is a perspective view of main circuit units of the vacuum circuit breaker of FIG. 1, which is shown from a different angle from FIG. 1.
Figure 3:
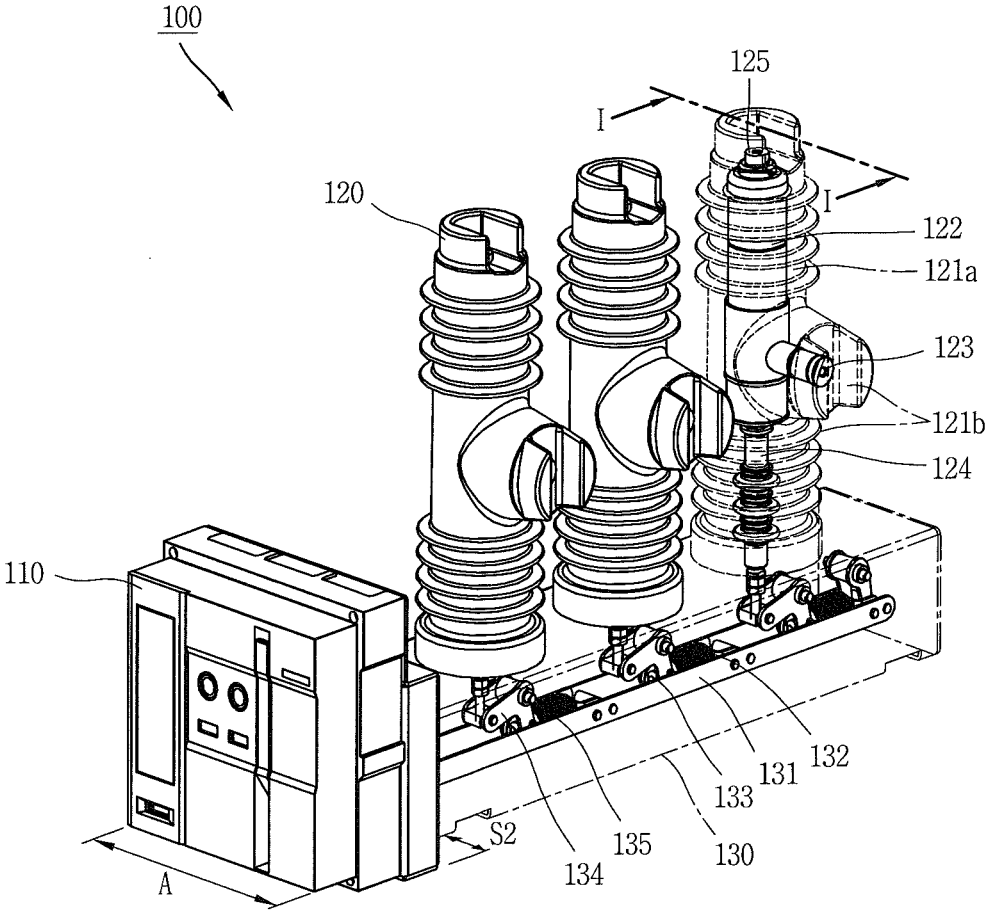
FIG. 3 is a perspective view of a vacuum circuit breaker according to a preferred embodiment of the present invention.
Figure 4:
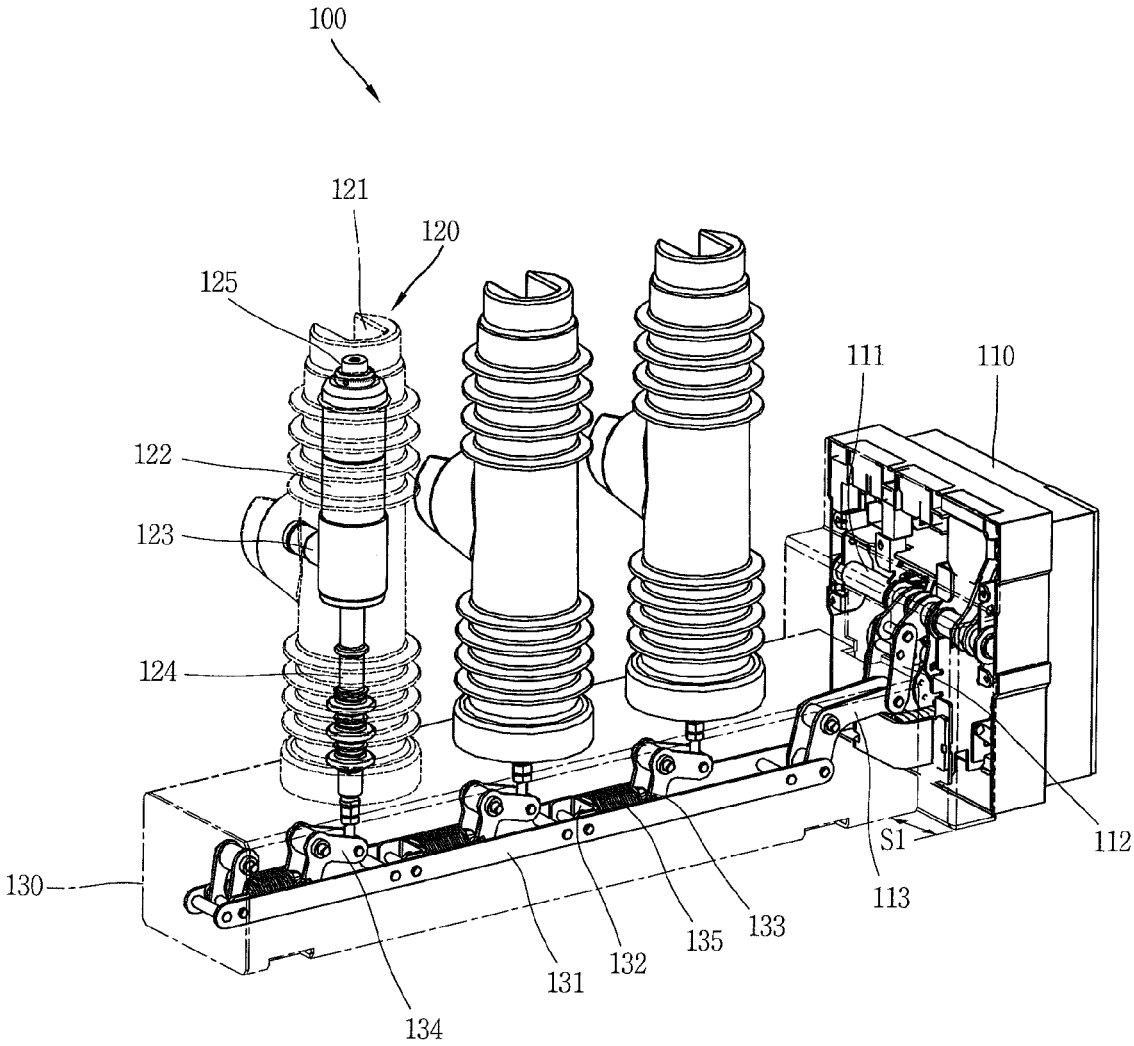
FIG. 4 is a perspective view of the vacuum circuit breaker of FIG. 3, which is shown from a different angle from FIG. 3.
Figure 5:
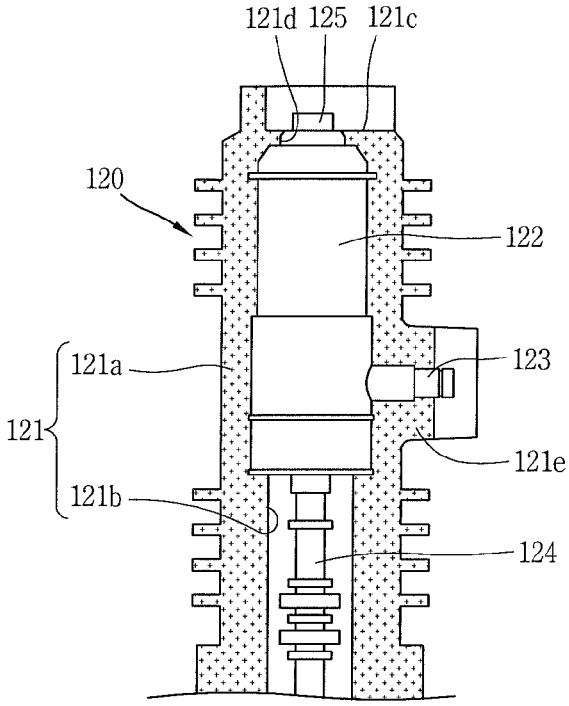
FIG. 5 is a sectional view of main circuit units of the vacuum circuit breaker of FIG. 4, which is taken along line 'I-I' in FIG. 4.
Figure 6:
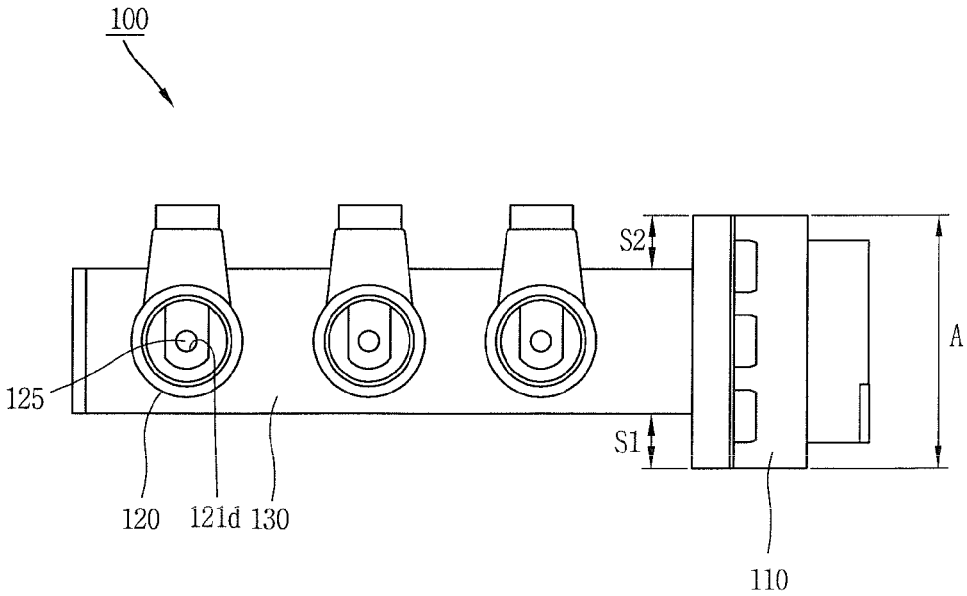
FIG. 6 is a planar view of the vacuum circuit breaker of FIG. 3.

FIG. 3 is a perspective view of a vacuum circuit breaker according to a preferred embodiment of the present invention, FIG. 4 is a perspective view of the vacuum circuit breaker of FIG. 3, which is shown from a different angle from FIG. 3, FIG. 5 is a sectional view of main circuit units of the vacuum circuit breaker of FIG. 4, which is taken along line 'I-I' in FIG. 4, and FIG. 6 is a planar view of the vacuum circuit breaker of FIG. 3.

As shown, a vacuum circuit breaker 100 according to the present invention comprises a driving unit 110, main circuit units 120 disposed at a rear side of the driving unit 110, and a frame unit 130 coupled to a rear surface of the driving unit 110 and having the main circuit units 120 on an upper surface thereof.

The driving unit 110 has a structure to generate driving energy by using a spring force, and is provided with a rotation shaft 111 installed therein so as to transfer a rotary motion. A connection member 112 and a conversion link 113 for converting a rotary motion of the rotation shaft 111 to a linear motion are coupled to the rotation shaft 111. The connection member 112 is integrally coupled to the rotation shaft 111, and the conversion link 113 is rotatably coupled to the connection member 112.

The main circuit units 120 include a housing 121, a vacuum interrupter 122 mounted in the housing 121, a first conductor 123 coupled to one side of the vacuum interrupter 122 and electrically connected to an internal conductor (not shown) of the vacuum interrupter 122, and an insulation rod 124 rotatably coupled to a direction conversion link to be later explained at a lower end of the vacuum interrupter 122, and operating a moveable electrode (not shown) of the vacuum interrupter 122 by a driving force of the driving unit 110.

The housing 121 is formed by molding using epoxy in a state that the vacuum interrupter 122 and the first conductor 123 are connected to each other. As shown in FIG. 5, the housing 121 consists of a sealing portion 121*a* for molding an outer circumferential surface of the vacuum interrupter 122 from an upper end of the vacuum interrupter 122 to a lower end of the first conductor 123, and a space portion 121*b* disposed below the sealing portion 121*a*, i.e., from a lower end of the first conductor 123 to a lower end of the housing 121 so that the insulation rod 124 can be moveable in upper and lower directions.

In order to firmly mold the vacuum interrupter 122 and the first conductor 123, the sealing portion 121*a* is preferably formed such that an upper end thereof covers an upper end of the vacuum interrupter 122, and a lower end thereof covers a bottom surface or an outer circumferential surface of the vacuum interrupter 122 below the first conductor 123. A conductor sealing portion 121*e* for sealing the first conductor 123 is protruding from an outer circumferential surface of the sealing portion 121*a* in a horizontal direction. Through the conductor sealing portion 121*e*, the first conductor 123 is partially exposed to the outside.

A busbar insertion recess 121*c* for inserting one busbar of a switchgear is concaved at an upper end of the housing 121 by a predetermined depth. On a bottom surface of the busbar insertion recess 121*c*, formed is a conductor hole 121*d* through which a second conductor 125 extending from a fixed electrode mounted in the vacuum interrupter 122 is upwardly protruding to be exposed out. More concretely, differently from the conventional art where the second conductor 125 is mechanically connected to the vacuum interrupter 122 by an additional conductor member, a conductor extending from the vacuum interrupter 122 is utilized in the present invention. This may reduce the number of processes, and reduce fabrication costs.

The frame unit 130 includes a transfer link 131, a supporting plate 132, a spring guide 133, a direction conversion link 134, a contact pressure spring 135, etc., and is configured to convert a rotary motion of the rotation shaft 111 into a horizontal motion.

The frame unit 130 is connected to an intermediate part of a width (A) of the driving unit. An installation state of the circuit breaker of the present invention on a switchgear will be explained with reference to FIG. 6. The frame unit 130 is coupled to the intermediate part of the driving unit, and distances (s1 and s2) from two side surfaces of the frame unit to the driving unit 110 are equal to each other, approximately.

An exposed length of the first conductor 123 of the main circuit unit 120 is formed within a proper range. More concretely, the frame unit 130 and the driving unit 110 are coupled to each other at a position where a length ratio (S1/S2) between a length (S1) from one side surface of the frame unit to one side surface of the driving unit in a width direction and a length (S2) from another side surface of the frame unit to another side surface of the driving unit in a width direction is two or less. Alternatively, the frame unit 130 and the driving unit 110 are coupled to each other at a position where the first conductor 123 is protruding from an end of the driving unit 110 in a width direction by ½ of an exposed length of the first conductor 123 or less than.

The vacuum circuit breaker according to the present invention may have the following advantages.

Firstly, the rotation shaft 111 is rotated by using a driving force generated from the driving unit 110. A rotary force of the rotation shaft 111 is converted into a linear force via the connection member 112 and the conversion link 113, and then is transferred to the transfer link 131 of the frame unit 130. The transfer link 131 is moved to a horizontal direction by the conversion link 113.

The horizontal motion of the transfer link 131 is converted into a vertical motion, through the contact pressure spring 135 and the direction conversion link 134 connected to the transfer link 131. As the insulation rod 125 and a movable contact inside the main circuit units 120 vertically move, the movable contact comes in contact with a fixed contact. Even after the movable contact has come in contact with the fixed contact, the rotation shaft 111 rotated by a driving force generated from the driving unit 110 continues to receive a rotary force. As a result, the transfer link 131 receives a force to continue a horizontal motion. However, the direction conversion link 134 is not moved any longer. Accordingly, the spring supporting plate 132 is horizontally moved along the spring guide 133 thereby to compress the contact pressure spring 135. In a state that the contacts have a constant contact pressure therebetween, a closing operation is completed. This may allow the contact pressure to overcome an electronic repulsive force during a current flowing operation, and to be utilized as energy during a current breaking operation. On the contrary, when separating the movable contact from the fixed contact by removing a latch for maintaining a closed state from the driving unit 110, an opening operation is performed in a direction opposite to that of the closing operation.

The main circuit units 120 of the vacuum circuit breaker may have a reduced size as the vacuum interrupter 122 and the conductor 123 are sealed by molding using epoxy. Furthermore, since the main circuit units 120 are in a solid-insulated state by molding using epoxy, an insulation reliability may be enhanced.

In the vacuum circuit breaker 100 of the present invention, power supplying to the switchgear may be implemented at the left or right side according to an installation situation of the switchgear. Accordingly, in the conventional case where the frame unit 130 is coupled to one side of the driving unit 110 in a completely eccentric manner, the main circuit units may be interfered with a panel of the switchgear according to an arrangement state thereof. This may cause rearrangement of the switchgear including the vacuum circuit breaker. However, in the present invention, the frame unit 130 is coupled to the intermediate part of the driving unit 110. This may allow an insulation distance between terminals of the panel of the switchgear and the main circuit units 120 of the vacuum circuit breaker not to be changed regardless of an arrangement state of the main circuit units 120. Accordingly, it is advantageous to arrange the switchgear including the vacuum circuit breaker. Furthermore, this may solve the conventional problem that the switchgear has to be differently configured according to whether power supplying is implemented at the left side or at the right side.

As the components of the main circuit units are integrally formed as one module by molding using epoxy, the main circuit units may be easily fabricated, and assembly errors may be prevented.

Furthermore, since the main circuit units are arranged to be symmetrical to each other based on the driving unit, an insulation distance between the switchgear and the main circuit units may be obtained without increasing a size of the switchgear. This may allow the main circuit units to be easily arranged at the right or left side according to an installation state of the switchgear.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A vacuum circuit breaker, comprising:

a driving unit configured to generate a driving force necessary to perform a breaking operation;

a frame unit horizontally coupled to the driving unit and configured to transfer the driving force of the driving unit; and a plurality of main circuit units vertically coupled to the frame unit each having a vacuum interrupter for performing a breaking operation by receiving the driving force from the frame unit, wherein the driving unit comprises:

a rotation shaft configured to transfer a rotational force of a motor;

a connection member having one end eccentrically coupled to the rotation shaft; and a conversion link coupled to another end of the connection member and configured to convert a rotary motion of the rotation shaft into a linear motion, wherein the frame unit comprises:

a transfer link coupled to the conversion link and configured to perform a horizontal linear motion in a direction according to a direction of rotation of the rotation shaft; and a plurality of direction conversion links coupled to the transfer link and configured to convert the horizontal linear motion of the transfer link into a vertical linear motion;

wherein each of the plurality of main circuit units comprises:

a housing configured to accommodate the vacuum interrupter therein;

a first conductor mechanically coupled to the vacuum interrupter such that the first conductor is electrically connected to the vacuum interrupter; and an insulation rod having one end coupled to the vacuum interrupter and the other end coupled to a direction conversion link of the frame unit, the insulation rod configured to operate the vacuum interrupter by a driving force transferred through the direction conversion link of the frame unit, and wherein the frame unit and the driving unit are coupled to each other at a position where a distance from one side surface of the frame unit to one side surface of the driving unit is equal to a distance from another side surface of the frame unit to another side surface of the driving unit.

2. The vacuum circuit breaker of claim 1, wherein:

each housing is provided with a sealing portion integrally coupled to the corresponding vacuum interrupter by molding and a space portion formed at a lower end of the sealing portion and having an opened lower end in order to accommodate movement of the corresponding insulation rod therein, and each sealing portion is configured to partially cover an upper end and a lower end of the corresponding vacuum interrupter such that the vacuum interrupter is fixed in a longitudinal direction.

3. The vacuum circuit breaker of claim 2, wherein:

a conductor hole is formed on an upper end of each sealing portion; and a conductor of the corresponding vacuum interrupter is exposed through the conductor hole as a second conductor.

4. The vacuum circuit breaker of claim 3, wherein:

each sealing portion is further configured to seal a connection between the corresponding first conductor and the corresponding vacuum interrupter;

each sealing portion comprises a horizontally protruding conductor sealing portion; and each first conductor is partially exposed through the corresponding conductor sealing portion.

5. The vacuum circuit breaker of claim 3, wherein the first and second conductors of each of the plurality of main circuit units are formed to be perpendicular to each other.

6. The vacuum circuit breaker of claim 1, wherein the connection member is coupled to a center of the rotation shaft.

7. The vacuum circuit breaker of claim 1, wherein the frame unit and the driving unit are coupled to each other at a position such that an end of at least one first conductor of the plurality of main circuit units extends past an end of the driving unit by no more than ½ of a length of an exposed portion of the first conductor.

* * * * *